United States Patent [19]

Werner

[11] Patent Number: 4,518,838

[45] Date of Patent: May 21, 1985

[54] MULTIPOLE HIGH VOLTAGE CIRCUIT BREAKER

[75] Inventor: Peter Werner, Oberursel, Fed. Rep. of Germany

[73] Assignee: Siemens Aktiengesellschaft, Berlin & Munich, Fed. Rep. of Germany

[21] Appl. No.: 533,734

[22] Filed: Sep. 19, 1983

[30] Foreign Application Priority Data

Feb. 8, 1983 [DE] Fed. Rep. of Germany ..... 3304272

[51] Int. Cl.[3] ..... H01H 19/04

[52] U.S. Cl. ..... 200/303; 200/255

[58] Field of Search ..... 200/254, 255, 307, 303

[56] References Cited

U.S. PATENT DOCUMENTS 3,286,070 11/1966 Volker ..... 200/303
3,514,554 5/1970 Boysen ..... 200/303
4,412,116 10/1983 Golub ..... 200/307

FOREIGN PATENT DOCUMENTS 1041573 10/1958 Fed. Rep. of Germany ..... 200/255

*Primary Examiner*—Stephen Marcus
*Assistant Examiner*—Rence S. Kidorf
*Attorney, Agent, or Firm*—Kenyon & Kenyon

[57] ABSTRACT

A multipole high voltage circuit breaker is provided with a housing formed of a pair of flanged housing shells which are snap-fitted together along adjoining peripheral flanges. The thus assembled housing is provided with a plurality of intermediate walls and end walls for defining a plurality of compartments corresponding to respective ones of the poles of the circuit breaker. A switch actuator shaft is formed of a plurality of tubular bodies which are housed in respective ones of the compartments and coupled together for joint rotation. A plurality of fixed contacts extend through the housing and are bent so as to be directed radially toward the switch actuator shaft. The arrangement further includes a plurality of switch elements arranged on the switch actuator shaft, the elements being movable between engaged and disengaged positions with respect to the fixed internal contacts upon rotation of the switch actuator shaft. In a preferred arrangement, the shells which form the housing are identical to one another so as to be producible in only one mould. Each shell is provided with a peripheral flange which contains pins and mating recesses. When assembled, the pins engage in the recesses and are deformed to prevent separation of the shells. In this manner, an easily assembly multipole circuit breaker is produced.

13 Claims, 6 Drawing Figures

MULTIPOLE HIGH VOLTAGE CIRCUIT BREAKER

BACKGROUND OF THE INVENTION

This invention relates generally to multipole high voltage circuit breakers, and more particularly, to such a circuit breaker having an insulating housing in which internal contacts are fixedly mounted, and a switch-actuator shaft extends through the housing for supporting switching elements which are displaceable therealong between engaged and disengaged positions with respect to the fixed internal contacts upon rotation of the shaft, each switching element having a pair of jaws spaced apart from one another to receive a respective contact therebetween.

A high voltage circuit breaker of the type described hereinabove is generally known from German Utility Model No. 7921721.

Accordingly, it is an object of the present invention to provide a high voltage circuit breaker which can be assembled simply and inexpensively.

SUMMARY OF THE INVENTION

The foregoing and other objects are achieved by this invention which provides a multipole high voltage circuit breaker of the type having an insulating housing in which internal contacts are fixedly mounted, and a switch actuator shaft extending through the housing and carrying switch elements which are movable between engaged and disengaged positions. Such switching elements move with respect to fixed internal contacts upon rotation of the shaft. Each such switching element is further provided with a pair of jaws which are spaced apart to receive a respective contact therebetween. In accordance with the invention, the housing is comprised of a pair of flanged housing shells which are snap-fitted together along adjoining peripheral flanges thereof and which define a plurality of compartments, each corresponding to a respective one of the poles of the circuit breaker. In addition, the switch actuator shaft comprises a plurality of tubular bodies each housing in a respective one of said compartments and coupled together for joint rotation.

In a preferred embodiment of the invention, each pair of jaws forms a contact bridge which connects together a respective pair of the fixed contacts. The jaws of each pair are surrounded by U-shaped brackets which retain the jaws, such that the jaws project from the U-shaped brackets for engaging with the fixed contacts. Springs are arranged between the jaws and the brackets to retain the jaws in position. Each tubular body has, at one end thereof, a circular bearing groove, and in front of the groove there is provided an internal drive formation. At the other end of each tubular body there is provided an external drive formation which is engageable with the internal drive formation of an adjacent tubular body so as to transmit drive therebetween. A pair of spaced-apart wings is secured to each tubular body. A cross tube is secured through the tubular body in the plane of the wings, and therebetween. A respective contact bridge is securely housed in each cross tube against rotation, and projects from the cross tube to extend in the region between the spaced-apart wings. The external drive formation of the tubular body at one end of the switch actuator shaft is engaged drivingly by an actuator which is operable to rotate the switch actuator shaft, the actuator having a bearing groove.

Each housing shell is comprised of a pair of end walls and a number of intermediate walls, the walls being formed by semiannular discs and the intermediate walls of the two shells cooperating with each other to form boundary walls for each pole of the circuit breaker, and the end walls and the intermediate walls being engaged by bearing grooves of the tubular bodies so as to mount the switch actuator shaft in the housing. At least one outwardly projecting stub in which a respective contact piece is fixedly mounted to form one of the fixed contacts is provided per pole for each shell of the circuit breaker.

It is a feature of the present invention that the circuit breaker described herein can be assembled readily without the need of any threaded fasteners, and no special tools are required to join the individual parts together.

BRIEF DESCRIPTION OF THE DRAWINGS

Comprehension of the invention is facilitated by reading the following detailed description in conjunction with the annexed drawings, in which.

DETAILED DESCRIPTION

Figure 4:
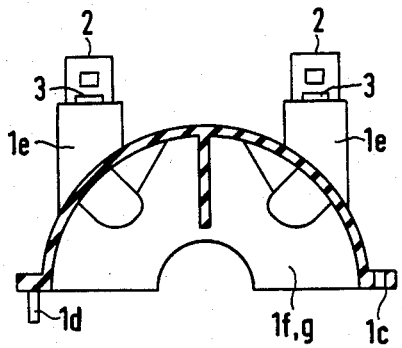
FIG. 4 is a partly cross-sectional view taken along line IV—IV in FIG. 1.

Referring to the drawings, a multipole high voltage circuit breaker is shown having an insulating housing in which internal contacts are fixedly mounted, and a switch actautor shaft extending through the housing and carrying switch elements which are movable between engaged and disengaged positions with respect to the fixed internal contacts upon rotation of the shaft. The insulating housing is formed of a pair of housing shells 1*a*, shown in FIG. 1, which are snap-fitted together along peripheral flanges 1*b* of the shells. Fixed internal contacts are provided in the housing by means of contact pieces 2 which are mounted in projecting stubs 1*e* on the outer wall of shells 1*a*, and which extend inwardly of the housing as shown in FIG. 4.

Figure 1:
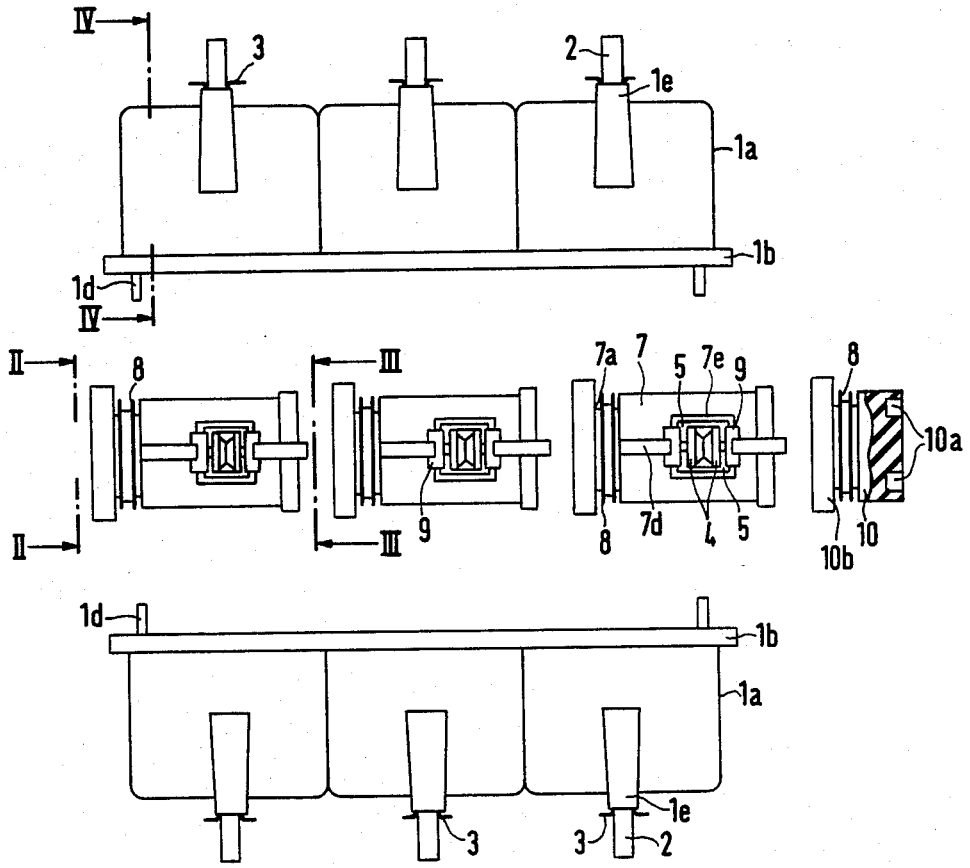
FIG. 1 is an exploded view of a multipole high voltage circuit breaker constructed in accordance with the invention.

FIG. 1 shows shells 1*a* of the housing in exploded form, with the switch actuator shaft located therebetween. The switch actuator shaft is formed by a plurality of tubular bodies 7 which carry switch elements each comprising a pair of jaws 4 which are spaced apart to receive the radially inwardly projecting end of a respective one of contact pieces 2.

Shells 1*a* of the housing are identical in construction, such that a single mould can be used to form both parts. As will be seen from FIG. 4, shells 1*a* have an approximately semicircular cross-section, and each is provided with a respective circular flange 1*b*. When assembled, flanges 1*b* of shells 1*a* lie on top of one another, and enclose an approximately cylindrical chamber. In addition, the assembled shells define a plurality of compartments each corresponding to a respective one of the poles of the circuit breaker. To permit snap-fitting together of the shells 1*a* along the adjoining peripheral flanges 1*b*, locking pins 1*d* and matching recesses 1*c* are provided on flanges 1*b*; pins 1*d* of each one of shells 1*a* being received aligningly by respective recesses 1*c* of the other of the shells.

Pins 1*d*, when assembled, are respectively shaped at their free ends to form pin heads (not shown) which are arranged so that two adjoining shells can no longer be separated from one another without destroying all of the pin heads.

Each of contact pieces 2, which forms a fixed internal contact, is bent at an angle, as shown in FIG. 4, and is inserted in the respective generally radially extending stub 1*e* from the inside to the outside up to the bearing surfaces of the inner bent edge on the inner side of associated shell 1*a*, and is secured against withdrawal. In the specific illustrative embodiment, the angle bends of contact pieces 2 projecting into the cavity of the shells extend toward the axes of the respective shells.

Shifting of a contact piece 2 in the insertion direction is prevented by the abutment of a bearing surface of the inner bent edge of the contact piece against the inside of associated shell 1*a*. Each such contact piece is secured against withdrawal by a spring retainer piece 3 which extends between the surfaces of respective stub 1*e*, and of contact piece 2, which are adjacent to one another. Spring retainer piece 3 engages in a depression of contact piece 2 (not shown) and is placed around the head of stub 1*e*.

Each shell 1*a* is provided with a minimum of only one contact piece 2, rather than two, per pole. In this case, stub 1*e* associated with one contact piece can, in a manner not shown, be moulded on top of respective shell 1*a*. In the specific illustrative embodiment, one contact piece 2 of one shell 1*a* is respectively associated with the diagonally opposite contact piece 2 of the other shell 1*a*. Contact pieces 2, for each pole respectively associated with another, can be joined together by a current bridge. The current bridges of all of the poles of the circuit breaker are carried by a shaft which can be rotated from a zero position into an EARTH switching position, and in the opposite direction to an ON switching postion. In the EARTH switching position, contact pieces 2 of a pole associated with another are joined together by the respective current bridge, thereby providing a three position switch. A two position switch is formed by utilizing the zero position of the shaft and only two contact pieces per pole.

Figure 5:
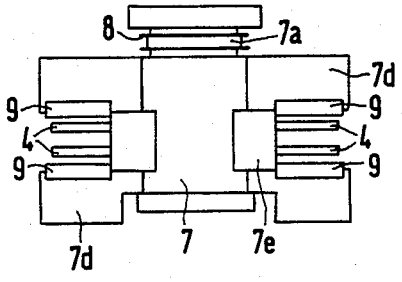
FIG. 5 is a plan view of one of a number of tubular bodies which form the switch actuator shaft.
Figure 6:
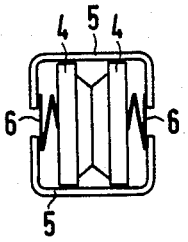
FIG. 6 is an enlarged front view of a contact bridge carried by each of the tubular bodies to make contact with fixed internal contacts arranged in the insulative housing.

As shown in FIGS. 1, 5, and 6, each current bridge consists of two contact jaws 4 which are surrounded by two brackets 5 (FIGS. 1 and 6) that are the same as each other and which surround the backs of contact jaws 4 with their arms. At both of their ends, the contact jaws project from U-shaped brackets 5 and there, as shown in FIG. 5, they have a clearance that is sufficient for the contacting arrangement of contact jaws 4.

As can be seen from FIG. 6, contact pressure springs 6, which are also used for holding together contact jaws 4 and brackets 5, extend between brackets 5 and the backs of contact jaws 4. The switch actuator shaft is comprised of a plurality of tubular bodies 7 formed of insulating material, and an actuator 10, which also consists of insulating material. One tubular body 7 is provided for each pole.

Figure 2:
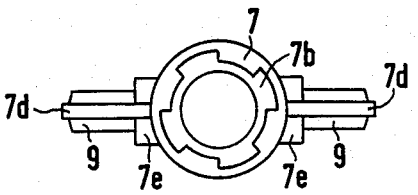
FIG. 2 is a view of a portion of the embodiment of FIG. 1 taken at line II—II.

A circular bearing groove 7*a* is arranged at one end of each tubular body 7, and is provided with an inset sliding ring 8. In front of bearing groove 7*a* there is provided an internal drive formation in the form of gearing 7*b*, shown in FIG. 2.

Figure 3:
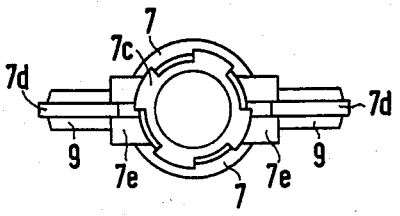
FIG. 3 is a view of a portion of the embodiment of FIG. 1 taken along line III—III of FIG. 1.

A moulded-on external drive formation in the form of gearing 7*c*, shown in FIG. 3, is provided at the other end of each tubular body 7. Each tubular body 7 has, in addition, two moulded wings 7*d*. In the plane of wings 7*d* there projects a cross tube 7*e*, shown in FIGS. 2, 3, and 5, which is formed on tubular body 7. At the ends of each cross tube 7*e*, the respective wings 7*d* are divided into two halves, as shown in FIG. 5. Into each cross tube 7*e* there is respectively inserted, fixed against rotation, one of the current bridges consisting of parts 4, 5, and 6, such that contact jaws 4 project between the halves of wings 7*d*. The current bridges are secured against shifting out of their ideal position by shaped elements 9, one of which is detachably placed on each half of wings 7*d*.

As assembled, internal gearing 7*b* of one tubular body 7 engages with external gearing 7*c* of an adjacent tubular body 7. On internal gearing 7*b* of tubular body 7, at one end of the shaft, i.e., gearing 7*b* which is not engaged by one of internal gearing 7*c*, there is placed an external gearing of actuator 10 which is also tubular. This has, in its free front surface, two recesses 10*a* for engagement of a drive shaft or other drive transmitter (not shown). Moreover, actuator 10 is provided with a bearing groove 10*b* which is a sliding ring.

In FIG. 1, all of tubular bodies 7 and actuator 10 are shown in alignment. Putting together all of these parts results in the formation of the shaft of the circuit breaker.

Each shell 1*a* has two end walls 1*f*, and, between each pole, intermediate walls 1*g* shown in FIG. 4. Intermediate walls 1*g*, together with end walls 1*f* and outer shell 1*a* form boundary walls for the pole compartments. The intermediate walls separate the poles from one another while end walls 1*f* seal off the housing. End walls 1*f* and intermediate walls 1*g* are each shaped as a half of an annular disc, as shown in FIG. 4.

After assembling shells 1*a*, the end and intermediate walls engage in one of the bearing grooves and/or sliding rings 8 of the shaft surrounded by shells 1*a*, and formed from tubular bodies 7 and actuator 10. The switch actuator shaft is thereby supported fourfold in the illustrated example.

The illustrated embodiment of the inventive multipole high voltage circuit breaker provides a construction which is assembled more simply than known devices, in that no screws or threaded fasteners are required to connect the parts together. Moreover, no special tools are required. The tubular bodies of the switch actuator shaft are readily coupled together, and then the two shells of the insulating housing are pressed together into locking engagement, while simultaneously retaining and mounting the switch actuator shaft in position. The fixed contacts, provided by contact pieces 2, are readily assembled, as also are the switch elements, provided by jaws 4 and brackets 5, which are mounted on the tubular bodies of the actuator shaft.

Although the invention has been disclosed in terms of specific embodiments and applications, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. A multipole high voltage circuit breaker comprising:

at least two flanged housing shells for joining together along respective peripheral flanges for forming a housing and defining a plurality of compartments corresponding to respective poles of the circuit breaker;

a plurality of tubular bodies housed in respective ones of said compartments and joined to one another for joint rotation as a switch actuator shaft;

an external drive element on each of said tubular bodies, each tubular body further having a circular bearing groove in the vicinity of said external drive element;

an internal drive element arranged at an end of each of said tubular bodies which is distal from said external drive element, said internal drive element being engageable with an external drive element of an adjacent tubular body for transmitting drive therebetween;

a plurality of end walls and intermediate walls formed of semiannular discs for cooperating with said flanged housing shells to form boundary walls for each pole of the circuit breaker, said end walls and intermediate walls being engaged by said bearing grooves of said tubular bodies for mounting said switch actuator shaft in said housing;

a plurality of internal contacts fixedly mounted in said housing; and a plurality of switch elements arranged on said switch actuator shaft, said switch elements being movable between engaged and disengaged positions with respect to said fixed internal contacts upon rotation of said switch actuator shaft, each switch element having a pair of jaws which are spaced apart to receive a respective internal contact therebetween.

2. The circuit breaker of claim 1 wherein said flanged housing shells of said housing are identical to one another.

3. The circuit breaker of claim 1 wherein said peripheral flanges of said flanged housing shells are provided with locking pins and matching recesses, said locking pins of each of said shells being received lockingly by respective matching recesses of the other of the shells.

4. The circuit breaker of claim 3 wherein said locking pins are deformable so as to form pin heads which oppose relative separation of said peripheral flanges on respective ones of said flanged housing shells.

5. The circuit breaker of claim 1 wherein there is further provided:

a contact bridge for connecting a respective pair of said fixed internal contacts;

a U-shaped brackat for retaining each of said jaws of said switch element, said jaws projecting from said U-shaped brackets for engaging with said fixed internal contacts;

a plurality of springs arranged between said jaws and said U-shaped brackets for retaining said jaws in a predetermined position;

a pair of spaced apart wings secured to each tubular body;

a cross tube secured to each of said tubular bodies in the plane of, and between, said spaced apart wings;

a contact bridge associated with each of said tubular bodies for securing said cross tube against rotation, said contact bridge projecting from said cross tube to extend in a region between said spaced apart wings;

actuator means for drivingly engaging with said external drive formation of one of said tubular bodies at one end of said switch actuator shaft, said actuator means being operable to rotate said switch actuator shaft, said actuator means having a bearing groove; and a plurality of outwardly projecting stubs arranged in said flanged housing shells for forming said internal contacts.

6. The circuit breaker of claim 5 wherein there is further provided drive transmitter means engageable with an end surface of said actuator means for rotatingly driving said actuator means, said end surface being provided with a depression for engaging with said drive transmitter means.

7. The circuit breaker of claim 5 wherein each of said internal contacts is provided with a bent portion which is arranged within said flanged housing and extending generally radially inwardly toward said switch actuator shaft.

8. The circuit breaker of claim 5 wherein there is further provided at least one spring retainer for holding each of said internal contacts in a respective one of said projecting stubs, said spring retainer extending between the respective one of said internal contacts and an adjacent inner side of the respective one of said projecting stubs, said spring retainer engaging in a depression formed in said respective one of said internal contacts.

9. The circuit breaker of claim 5 wherein there is further provided sliding ring means in each of said bearing grooves.

10. The circuit breaker of claim 9 wherein each contact bridge is retained in a region between said spaced apart wings by means of shaped elements mounted on each half of said spaced apart wings.

11. A multipole high-voltage circuit breaker comprising:

at least two housing shells having respective peripheral flanges, said housing shells being joinable along said flanges to form a housing having an axis and defining a plurality of compartments corresponding to respective poles of the circuit breaker, said compartments being aligned with one another along said axis;

a plurality of tubular bodies housed in respective ones of said compartments and joined to one another for joint rotation about said axis as a switch actuator shaft;

a plurality of internal contacts fixedly mounted in said housing;

a plurality of pairs of spaced apart wings, each pair of said spaced apart wings being secured to one of said tubular bodies, said spaced apart wings being disposed in a longitudinal plane containing said axis;

a plurality of cross tubes each secured to a respective one of said tubular bodies in said longitudinal plane and between a respective pair of said spaced apart wings; and a plurality of switch elements arranged in respective ones of said cross tubes, said switch elements being movable between engaged and disengaged positions with respect to said fixed internal contacts upon rotation of said switch actuator shaft, each switch element having a pair of jaws which are spaced apart to receive a respective internal contact therebetween, each pair of said jaws having at least one end projecting from the respective cross tube and extending between the respective pair of said spaced apart wings.

12. The circuit breaker of claim 11, further comprising:

a plurality of cross-sectionally U-shaped brackets for retaining respective pairs of said jaws of said switch elements, each of said U-shaped brackets being disposed in a respective one of said cross tubes, said jaws projecting from said U-shaped brackets for engaging with said fixed internal contacts;

a plurality of springs each arranged between a pair of said jaws and a respective one of said U-shaped brackets for retaining said jaws in a predetermined position; and retainer means for securing said switch elements against shifting out of their positions in said cross tubes, said retainer means including a plurality of shaped elements detachably placed on at least one member of each pair of said spaced apart wings at an end of the respective cross tube.

13. A multipole high voltage circuit breaker comprising:

at least two flanged housing shells joinable together along respective peripheral flanges for forming a housing and defining a plurality of compartments corresponding to respective poles of the circuit breaker;

a switch actuator shaft having a plurality of circular bearing grooves longitudinally spaced from each other along said switch actuator shaft;

a plurality of end walls and intermediate walls formed of semiannular discs for cooperating with said flanged housing shells to form boundary walls for each pole of the circuit breaker, said end walls and intermediate walls being engaged by said bearing grooves of said switch actuator shaft for mounting said switch actuator shaft in said housing;

a plurality of internal contacts fixedly mounted in said housing; and a plurality of switch elements arranged on said switch actuator shaft, said switch elements being movable between engaged and disengaged positions with respect to said fixed internal contacts upon rotation of said switch actuator shaft, each switch element having a pair of jaws which are spaced apart to receive a respective internal contact therebetween.

* * * * *